US006229488B1

(12) United States Patent
Lin et al.

(10) Patent No.: US 6,229,488 B1
(45) Date of Patent: May 8, 2001

(54) ANTENNA FOR RECEIVING SIGNALS FROM GPS AND GSM

(75) Inventors: Huey-Jen Lin; Kuan-Cheng Chuang, both of Hsinchu (TW)

(73) Assignee: Emtac Technology Corp., Hsinchu (TW)

( * ) Notice: Subject to any disclaimer, the term of this patent is extended or adjusted under 35 U.S.C. 154(b) by 0 days.

(21) Appl. No.: 09/657,578

(22) Filed: Sep. 8, 2000

(51) Int. Cl.[7] ..... H01Q 1/38; H01Q 1/24

(52) U.S. Cl. ..... 343/700 MS; 343/895; 343/702; 343/725

(58) Field of Search ..... 343/700 MS, 895, 343/702, 725, 726, 728, 729; H01Q 1/38, 1/24, 1/36

(56) References Cited

U.S. PATENT DOCUMENTS 6,150,984 * 11/2000 Suguro et al. ..... 343/702

6,160,512 * 12/2000 Desclos et al. ..... 343/700 MS

* cited by examiner

*Primary Examiner*—Hoanganh Le
(74) *Attorney, Agent, or Firm*—Bacon & Thomas, PLLC

(57) ABSTRACT

An antenna for receiving signals from GPS and GSM comprises a cylindrical body formed of dielectric material, an axial central through hole, a first conductor layer coated on the bore of the through hole, a ground conductor layer coated on the bottom of the body being in contact with the first conductor layer, an insulator fitted into the through hole, a feeding pin provided in the center of the insulator with both ends extended above the top and the bottom of the body wherein the end atop the body being attached to a helical antenna, and a patch antenna formed on the circumferential surface of the body such that the antenna can receive signals from GPS and GSM respectively. This greatly reduces the size of antenna as well as reduces the manufacturing and transporting costs.

17 Claims, 4 Drawing Sheets

ANTENNA FOR RECEIVING SIGNALS FROM GPS AND GSM

FIELD OF THE INVENTION

The present invention relates to antenna, and more particularly to an antenna for receiving signals from Global Positioning System (GPS) and Global System for Mobile Communications (GSM).

BACKGROUND OF THE INVENTION

This is a scientific age. The communication between people in different continents has been made very convenient. This greatly expands the activity space of human beings. Thus, the entire globe is sometimes called a "village". Further, it is also desired that people can precisely identify the location of a person or an object whether moving or not. Thus a variety of Global Positioning System (GPS) and Global System for Mobile Communications (GSM) based communication equipment have been developed to fulfil such needs. Moreover, the use of such GPS and GSM based communication equipment have become a part of our daily life.

Conventionally, antenna of mobile phone and antenna of GPS based communication equipment are separated. That is, antenna of mobile phone can only receive communication signals, while GPS based communication equipment can only receive coordinate signals. As such, it is required to mount an antenna of mobile phone 11 and an antenna of GPS 12 on a digital communication equipment 10 for receiving GPS and GSM signals simultaneously as shown in FIG. 1. This inevitably increases cost as well as complicates installation procedure and wiring. It is thus much desired by the art to develop an antenna which can receive both communication signals from GSM and coordinate signals from GPS simultaneously.

Conventionally, a patch antenna is employed in GPS. Patch antenna has the advantages of compact, not susceptible to temperature change, and low power loss. As such, it is often that a patch antenna is mounted on a cylindrical member. One of such patch antennas is a ceramic patch antenna 20 as shown in FIG. 2. This ceramic patch antenna 20 is widely employed in GPS based communication equipment. As shown, patch antenna 20 comprises a substrate 21 made of ceramic material, a square or rectangular microstrip patch 22 and a ground plane 13 formed on the top and bottom respectively both by photolithography and etching, a coaxial cable 24 having a top feeding pin 241 penetrated through ground plane 23 and substrate 21 to contact with feeding point 221 of the microstrip patch 22, and an outer conductor 242 with part thereof being in contact with ground plane 23. This is a complete patch antenna 20. Further, signals are transmitted through feeding pin 241.

For receiving signals from GPS and GSM simultaneously, a typical implementation is to integrate patch antenna 20 of GPS and helical antenna 31 of GSM on sides of circuit board 30 as shown in FIG. 3. As such, it is possible to receive coordinate signals from GPS through patch antenna 20 and communication signals from GSM through helical antenna 31 respectively. As such, received signals are then filtered and amplified by electronics on the circuit board 30. Finally, signals are sent to digital communication equipment through cables 24 and 32 respectively. Such integration is advantageous over the one shown in FIG. 1. But it is still unsatisfactory for the purpose for which the invention is concerned for the following reasons:

1. Bulky.
2. Complicated manufacturing processes.
3. High cost.

Thus, it is desirable to provide an improved antenna for receiving signals from GPS and GSM having the advantages of slim, reliable, and inexpensive in order to overcome the above drawbacks of prior art.

SUMMARY OF THE INVENTION

It is an object of the present invention to provide an antenna apparatus wherein a patch antenna of GPS and a helical antenna of GSM are formed on a circumference of a dielectric body and a feeding pin in an axial central through hole thereof such that the antenna apparatus can receive signals from GPS and GSM respectively. It is possible to greatly reduce the size of the antenna apparatus as well as reduce the manufacturing and transporting costs.

It is another object of the present invention to provide an antenna apparatus wherein a patch antenna of GPS is formed on a periphery adjacent at one side of a dielectric body, a linearly polarized patch antenna of GSM is formed on a periphery adjacent at the other opposed side of the dielectric body, and the linearly polarized patch antenna is attached to a feeding pin in an axial central through hole of the dielectric body such that the antenna apparatus can receive signals from GPS and GSM respectively.

It is still another object of the present invention to provide an antenna apparatus wherein a patch antenna of GPS is formed on a periphery adjacent at one side of a dielectric body, a first linearly polarized patch antenna of GSM is formed on a periphery adjacent at the other opposed side of the dielectric body, a second linearly polarized patch antenna of GSM is formed on a periphery adjacent at the other opposed side of the dielectric body, and the linearly polarized patch antennas are attached to a feeding pin in an axial central through hole of the dielectric body such that the antenna apparatus can receive signals from GPS and dual tone signals from GSM respectively.

The above and other objects, features and advantages of the present invention will become apparent from the following detailed description taken with the accompanying drawings.

DETAILED DESCRIPTION OF THE PREFERRED EMBODIMENTS

Figure 1:
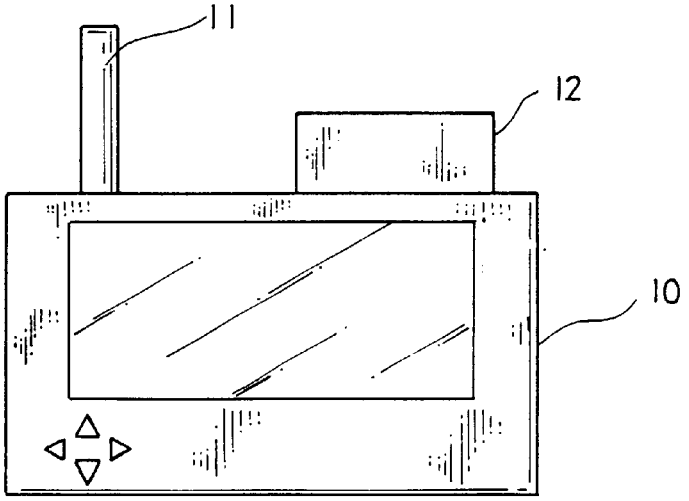
Fig.1 Prior art
FIG. 1 is a side view of a conventional communication equipment with both antenna of mobile phone and antenna of GPS mounted.
Figure 2:
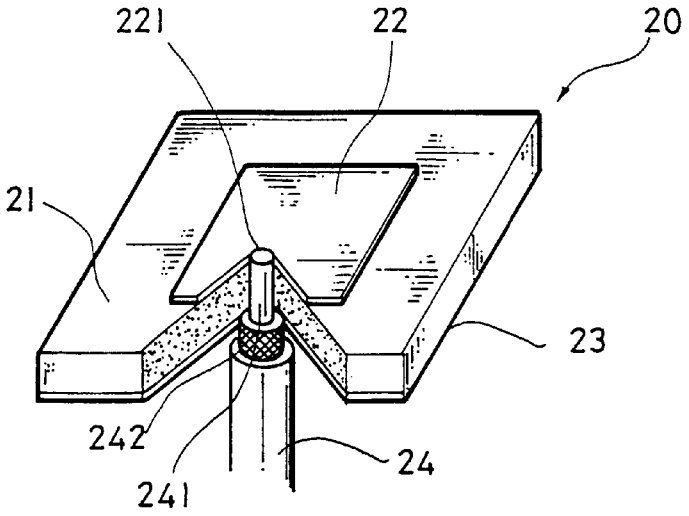
Fig. 2 Prior art
FIG. 2 is a perspective view in part section of a conventional ceramic patch antenna.
Figure 3:
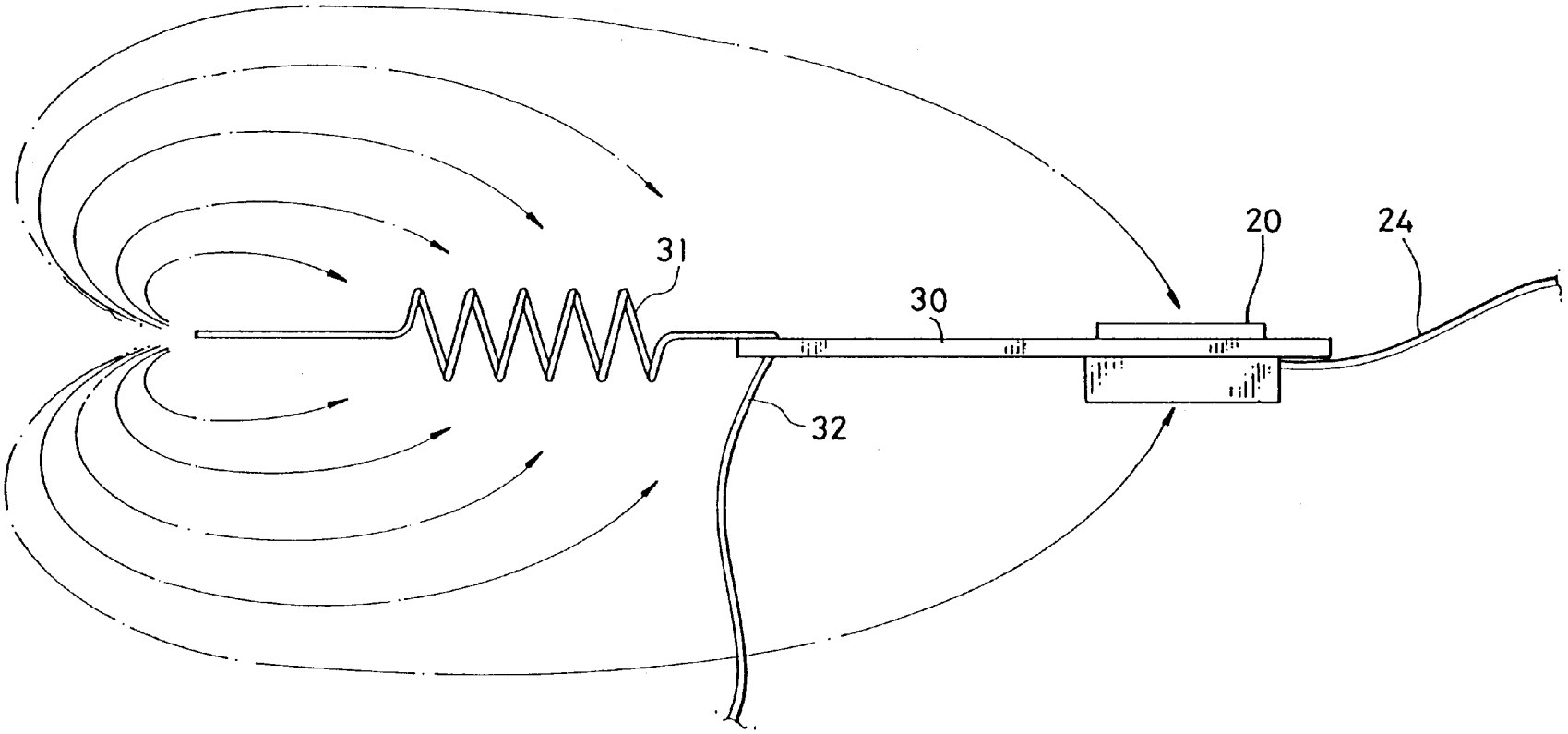
Fig. 3 Prior art
FIG. 3 is a side view of a conventional antenna device with patch antenna of GPS and helical antenna of GSM integrated thereon.
Figure 4:
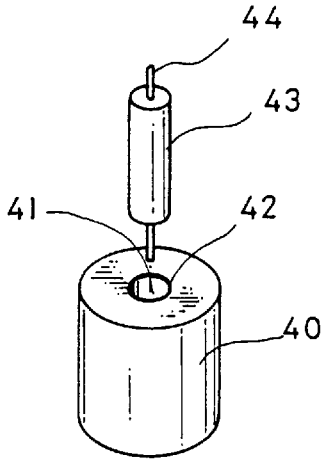
FIG. 4 is a perspective view of a antenna for receiving signals from GPS and GSM according to the invention.

Referring to FIG. 4, there is shown an antenna for receiving signals from GPS and GSM constructed in accordance with the invention comprising a cylindrical body 40 formed of dielectric material such as ceramic material or any one of other suitable polymeric materials, an axial central through hole 41, a layer of conductor 42 coated on the bore of central through hole 41, a cylindrical insulator 43 fitted into the bore of central through hole 41, and a feeding pin 44 provided in the center of insulator 43 with both ends extended above the top and bottom of cylindrical body 40 such that signals passed through feeding pin 44 may be shielded by conductor layer 42 from being interfered by electromagnetic wave. It is noted that body 40 is made as cylindrical shape in this description for the purpose of discussion only. It is understood that body 40 may be any of other shapes without departing from the scope of the invention.

Figure 5:
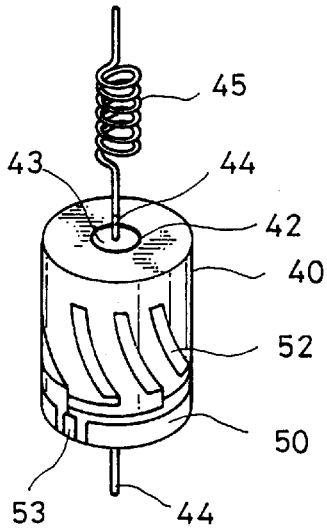
FIG. 5 is a perspective view of a first preferred embodiment of antenna for receiving signals from GPS and GSM according to the invention.
Figure 6:
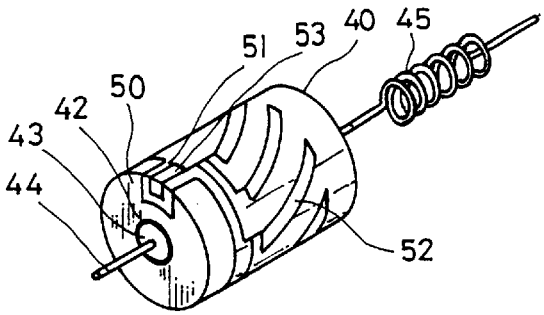
FIG. 6 is another perspective view of the antenna of FIG. 5.

Referring to FIGS. 5 and 6, there is shown a first preferred embodiment of antenna according to the invention. The antenna comprises a body 40, a layer of ground conductor 50 coated on the bottom of body 40, ground conductor layer 50 being in contact with conductor layer 42 at the bottom periphery of the central through hole 41, ground conductor layer 50 further axially extended upward a small distance from the bottom periphery, a recess 51 located on the bottom periphery, a patch antenna 52 consisting of a number of respective sections provided on the circumferential surface of body 40, patch antenna 52 being rightward polarized patch antenna for receiving GPS signals and suitably spaced from ground conductor layer 50, and feeding end 53 extended to recess 51 from ground conductor layer 50 and spaced apart from ground conductor layer 50.

Referring to FIG. 6 specifically, feeding end 53 of patch antenna 52 is extended to the bottom edge of body 40 as recess 51 extended to the bottom edge of body 40. In this embodiment, feeding pin 44 at one end of body 40 opposed to ground conductor layer 50 is attached to helical antenna 45 so as to receive GSM signals therefrom. As such, GSM and GPS signals may be received by helical antenna 45 and patch antenna 52 respectively. Then above signals are fed to a predetermined digital communication equipment for further processing via the feeding end 53 and electronics thereof and the feeding pin 44 and electronics thereof respectively.

Figure 7:
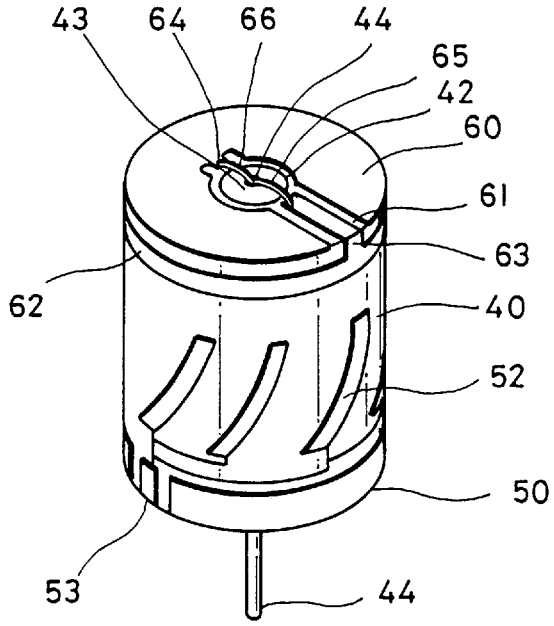
FIG. 7 is a perspective view of a second preferred embodiment of antenna for receiving signals from GPS and GSM according to the invention.

Referring to FIG. 7, there is shown a second preferred embodiment of antenna for receiving signals from GPS and GSM according to the invention. This embodiment is a variation of the first one. The antenna comprises a body 40, a layer of ground conductor 50 coated on the bottom of body 40, a linear patch antenna 60 coated on the top side opposed to the ground conductor layer 50, the linear patch antenna 60 being spaced from conductor layer 42 coated on the bore of central through hole 41 and further axially extended downward a small distance from the top of body 40, and a recess 61 located on the top. A circumferential linear patch antenna 62 is provided slightly below the top periphery of body 40. The linear patch antenna 62 is equally spaced from the linear patch antenna 60. Feeding end 63 of the linear patch antenna 62 is extended to recess 61 toward the linear patch antenna 60 and spaced apart from conductor layer 42 coated on the bore of central through hole 41.

In this embodiment, feeding pin 41 is no longer attached to helical antenna 45. Rather, a pair of opposed conductor strips 65 and 66 are provided across the central through hole 41. Feeding ends 63 and 64 of the linear patch antennas 60 and 62 are attached to feeding pin 44 respectively. As such, the linear patch antennas 60 and 62 may receive dual tone signals from GSM. With this, it is possible to eliminate helical antenna 45 and greatly reduce the length of antenna. Moreover, dual tone signals from GSM and signals from GPS are received by the linear patch antennas 60 and 62 respectively. Then above signals are fed to a predetermined digital communication equipment for further processing (e.g., filtering) via the feeding end 53 and electronics thereof and the feeding pin 44 and electronics thereof respectively.

Figure 8:
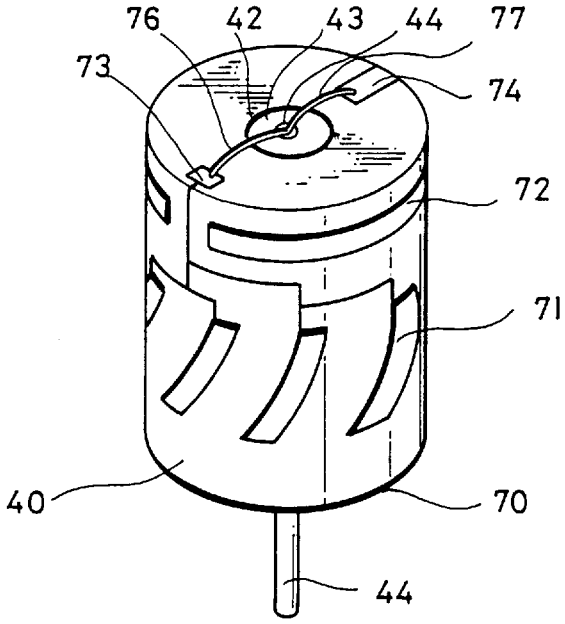
FIG. 8 is a perspective view of a third preferred embodiment of antenna for receiving signals from GPS and GSM according to the invention.

Referring to FIG. 8, there is shown a third preferred embodiment of antenna for receiving signals from GPS and GSM according to the invention. The antenna comprises a body 40, a layer of ground conductor 70 coated on the bottom of body 40, ground conductor layer 70 being in contact with conductor layer 42 at the bottom periphery of the central through hole 41, a patch antenna 71 consisting of a number of respective sections provided on the circumference of body 40, patch antenna 71 being rightward polarized patch antenna for receiving GPS signals, one feeding end 71 of patch antenna 71 extended to the top of body 40 and being suitably spaced from conductor layer 42 coated on the bore of central through hole 41, and a linear patch antenna 72 provided on the circumferential surface of body 40 below the top thereof, the linear patch antenna 72 being spaced apart from patch antenna 71 having one feeding end 74 extended to the top of body 40 and spaced from the conductor layer 42 coated on the bore of central through hole 41. Similarly, in this embodiment, feeding pin 44 is no longer attached to helical antenna 45. Rather, a pair of opposed conductor strips 76 and 77 are provided between feeding end 74 and 73. Feeding ends 73 and 74 of patch antennas 71 and 72 are attached to feeding pin 44 respectively. As such, patch antennas 71 and 72 may receive signals from GPS and GSM. Moreover, above signals are fed to a predetermined digital communication equipment for further processing (e.g., filtering) via the feeding pin 44 and electronics thereof.

While the invention herein disclosed has been described by means of specific embodiments, numerous modifications and variations could be made thereto by those skilled in the art without departing from the scope and spirit of the invention set forth in the claims.

What is claimed is:

1. An antenna apparatus for receiving signals from a Global Positioning System (GPS) and a Global System for Mobile Communications (GSM) comprising:

an elongated body formed of a dielectric material including an axial central through hole, a first conductor layer coated on the bore of the central through hole, an insulator fitted into the bore of the central through hole, and a feeding pin provided in the center of the insulator with both ends extended above one end and the other opposed end of the body;

a ground conductor layer provided on one end of the body being in contact with the first conductor layer at the periphery of the central through hole, the ground conductor layer being axially extended upward a predetermined distance from the periphery of one end of the body with a recess formed therein;

a patch antenna provided on the circumferential surface of the body being spaced from the ground conductor layer having a feeding end extended to the recess from the ground conductor layer and spaced apart from the ground conductor layer; and a helical antenna attached to the feeding pin at the other end of the body opposed to the ground conductor layer;

wherein signals from the GSM and the GPS are received by the helical antenna and the patch antenna respectively, and the received signals are fed to a digital communication means for processing via the feeding end and electronics thereof and the feeding pin and electronics thereof respectively.

2. The antenna apparatus of claim 1, wherein the elongated body has a cylindrical shape.

3. The antenna apparatus of claim 1, wherein the dielectric material is a ceramic material.

4. The antenna apparatus of claim 1, wherein the dielectric material is a polymeric material.

5. The antenna apparatus of claim 1, wherein the patch antenna is a rightward polarized patch antenna.

6. An antenna apparatus for receiving signals from a Global Positioning System (GPS) and dual tone signals from a Global System for Mobile Communications (GSM) comprising:

an elongated body formed of a dielectric material including an axial central through hole, a first conductor layer coated on the bore of the central through hole, an insulator fitted into the bore of the central through hole, and a feeding pin provided in the center of the insulator with both ends extended above one end and the other opposed end of the body;

a ground conductor layer provided on one end of the body being in contact with the first conductor layer at the periphery of the central through hole, the ground conductor layer being axially extended upward a predetermined distance from the periphery of one end of the body with a recess formed therein;

a patch antenna provided on the circumferential surface of the body being spaced from the ground conductor layer having a feeding end extended to the recess from the ground conductor layer and spaced apart from the ground conductor layer;

a first linear patch antenna provided on one end of the body opposed to the ground conductor layer being spaced from the first conductor layer, the first linear patch antenna further circumferentially extended downward with a recess formed therein;

a circumferential second linear patch antenna provided below one end of the body being spaced from the first linear patch antenna having a feeding end extended to the recess from the first linear patch antenna and spaced apart from the first conductor layer; and a pair of opposed conductor strips each having a feeding end attached to the feeding pin respectively;

wherein dual tone signals from the GSM and signals from the GPS are received by the linear patch antennas and the patch antenna respectively, and the received signals are fed to a digital communication means for processing via the feeding end of the patch antenna and electronics thereof and the feeding pin and electronics thereof respectively.

7. The antenna apparatus of claim 6, wherein the elongated body has a cylindrical shape.

8. The antenna apparatus of claim 6, wherein the dielectric material is a ceramic material.

9. The antenna apparatus of claim 6, wherein the dielectric material is a polymeric material.

10. The antenna apparatus of claim 6, wherein the patch antenna is a rightward polarized patch antenna.

11. The antenna apparatus of claim 6, wherein the elongated body has a cylindrical shape.

12. An antenna apparatus for receiving signals from a Global Positioning System (GPS) and dual tone signals from a Global System for Mobile Communications (GSM) comprising:

an elongated body formed of a dielectric material including an axial central through hole, a first conductor layer coated on the bore of the central through hole, an insulator fitted into the bore of the central through hole, and a feeding pin provided in the center of the insulator with both ends extended above one end and the other opposed end of the body;

a ground conductor layer provided on one end of the body being in contact with the first conductor layer at the periphery of the central through hole;

a patch antenna provided on the circumferential surface of the body being spaced from the ground conductor layer having a feeding end extended to the other end of the body being spaced from the first conductor layer; and a circumferential linear patch antenna provided below the other end of the body being spaced from the patch antenna having a feeding end extended to the other end of the body being spaced apart from the first conductor layer;

wherein dual tone signals from the GSM and signals from the GPS are received by the linear patch antennas and the patch antenna respectively, and the received signals are fed to a digital communication means for processing via the feeding end of the patch antenna and electronics thereof and the feeding pin and electronics thereof respectively.

13. The antenna apparatus of claim 12, wherein the elongated body has a cylindrical shape.

14. The antenna apparatus of claim 12, wherein the dielectric material is a ceramic material.

15. The antenna apparatus of claim 12, wherein the dielectric material is a polymeric material.

16. The antenna apparatus of claim 12, wherein the patch antenna is a rightward polarized patch antenna.

17. The antenna apparatus of claim 12, wherein each of the first and the second linear patch antennas is a linear polarized patch antenna.

* * * * *